US011661943B2

(12) United States Patent
Hu et al.

(10) Patent No.: US 11,661,943 B2
(45) Date of Patent: May 30, 2023

(54) COUNTER-ROTATING FAN

(71) Applicants: GUANGDONG MIDEA WHITE HOME APPLIANCE TECHNOLOGY INNOVATION CENTER CO., LTD., Foshan (CN); MIDEA GROUP CO., LTD., Foshan (CN)

(72) Inventors: Xiaowen Hu, Foshan (CN); Site Hu, Foshan (CN); Hui Zhang, Foshan (CN); Rong Yi, Foshan (CN)

( * ) Notice: Subject to any disclaimer, the term of this patent is extended or adjusted under 35 U.S.C. 154(b) by 0 days.

(21) Appl. No.: 17/283,528

(22) PCT Filed: Dec. 21, 2018

(86) PCT No.: PCT/CN2018/122531
§ 371 (c)(1),
(2) Date: Apr. 7, 2021

(87) PCT Pub. No.: WO2020/077813
PCT Pub. Date: Apr. 23, 2020

(65) Prior Publication Data

US 2021/0388838 A1 Dec. 16, 2021

(30) Foreign Application Priority Data

Oct. 15, 2018 (CN) ..... 201811198969.9

(51) Int. Cl.
*F04D 19/02* (2006.01)
*F04D 25/06* (2006.01)
(Continued)

(52) U.S. Cl.
CPC ..... *F04D 19/024* (2013.01); *F04D 25/06* (2013.01); *F04D 25/08* (2013.01); *F04D 25/166* (2013.01); *F04D 29/325* (2013.01); *F04D 29/582* (2013.01)

(58) Field of Classification Search
CPC ..... F04D 19/007; F04D 19/024; F04D 29/326–328; F01D 5/22–225; F01D 5/03
(Continued)

(56) References Cited

U.S. PATENT DOCUMENTS 3,143,283 A * 8/1964 Downs ..... F04D 25/166 415/77
6,591,873 B1 7/2003 McNeil
(Continued)

FOREIGN PATENT DOCUMENTS

CN 101105179 A 1/2008
CN 102052339 A 5/2011
(Continued)

OTHER PUBLICATIONS

How to Calculate Lift for Rotor Blades, by sciencing.com, published Sep. 1, 2017, URL: https://web.archive.org/web/20170901205639/http://sciencing.com/calculate-lift-rotor-blades-7680704.html (Year: 2017).*
(Continued)

*Primary Examiner* — Thomas Fink
(74) *Attorney, Agent, or Firm* — Kilpatrick Townsend & Stockton, LLP

(57) ABSTRACT

A counter-rotating fan, comprising two impellers and a motor. The motor is used for driving the two impellers to rotate. The two impellers are axially spaced apart from each other, and are divided into a first-stage impeller and a second-stage impeller. When the counter-rotating fan operates, airflow is blown to the direction of the second-stage impeller by means of the first-stage impeller. At least one impeller has turns of blades arranged in the radial direction of the impeller. Blades of each turn are spaced apart from each other around a hub of the impeller, and a spacer ring is connected between two adjacent turns of blades. The coun-
(Continued)

ter-rotating fan is stable in rotation and good in cooling effect, it is not easy to deform, and the wind is strong in the center.

6 Claims, 7 Drawing Sheets

(51) Int. Cl.

| | |
|---|---|
| ***F04D 25/08*** | (2006.01) |
| ***F04D 25/16*** | (2006.01) |
| ***F04D 29/32*** | (2006.01) |
| ***F04D 29/58*** | (2006.01) |

(58) Field of Classification Search
USPC ..... 415/77; 416/193 R, 203, 175, 196 R, 416/196 A
See application file for complete search history.

(56) References Cited

U.S. PATENT DOCUMENTS

| | | | | |
|---|---|---|---|---|
| 8,342,808 | B2 * | 1/2013 | Ota | F04D 29/325 416/169 A |
| 2003/0150326 | A1 * | 8/2003 | Chasen | F24F 8/10 55/471 |
| 2006/0257251 | A1 * | 11/2006 | Carlson | F04D 29/544 415/178 |
| 2006/0276122 | A1 | 12/2006 | Cheng | |
| 2008/0260526 | A1 | 10/2008 | Nishizawa et al. | |
| 2011/0052433 | A1 | 3/2011 | Huang | |
| 2013/0170995 | A1 * | 7/2013 | Chen | F04D 29/326 416/193 R |
| 2014/0086730 | A1 * | 3/2014 | Chang | F04D 25/166 415/143 |
| 2019/0063443 | A1 * | 2/2019 | Liu | F04D 25/0613 |

FOREIGN PATENT DOCUMENTS

| | | | | |
|---|---|---|---|---|
| CN | 201818521 | U | 5/2011 | |
| CN | 102227562 | A | 10/2011 | |
| CN | 202451460 | U | 9/2012 | |
| CN | 102705269 | A | 10/2012 | |
| CN | 102808793 | A | 12/2012 | |
| CN | 202597137 | U | 12/2012 | |
| CN | 203114677 | U | 8/2013 | |
| CN | 203189324 | U | 9/2013 | |
| CN | 103696987 | A | 4/2014 | |
| CN | 106050713 | A | 10/2016 | |
| CN | 106968973 | A | 7/2017 | |
| CN | 206694277 | U | 12/2017 | |
| CN | 207795606 | U | 8/2018 | |
| CN | 207892890 | U | 9/2018 | |
| DE | 102007022663 | A1 * | 12/2007 | F04D 19/007 |
| EP | 0691477 | A1 | 1/1996 | |
| EP | 0761979 | A1 | 3/1997 | |
| EP | 0846869 | A2 | 6/1998 | |
| JP | S5261620 | A | 5/1977 | |
| JP | 3071456 | U | 9/2000 | |
| JP | 2001050191 | A | 1/2001 | |
| JP | 2014196713 | A | 10/2014 | |

OTHER PUBLICATIONS

Shape effects on lift, by NASA.gov, published Mar. 18, 2017 URL: https://web.archive.org/web/20170318015326/https://www.grc.nasa.gov/WWW/k-12/airplane/shape.html (Year: 2017).*

The Lift Equation, by NASA.gov, published Nov. 12, 2016, URL: https://web.archive.org/web/20161112233647/http://www.grc.nasa.gov/WWW/K-12/airplane/lifteq.html (Year: 2016).*

Aircraft Systems, by FAA.gov, published Jun. 29, 2017, URL: https://web.archive.org/web/20170629233321/https://www.faa.gov/regulations_policies/handbooks_manuals/aviation/phak/media/09_phak_ch7.pdf (Year: 2017).*

Supplementary European Search Report regarding the EP counterpart 18936996.0.

The first OA of CN Application No. 201811198969.9.

The second OA of CN Application No. 201811198969.9.

First OA of JP Application No. 2021-515113.

* cited by examiner

COUNTER-ROTATING FAN

CROSS-REFERENCES TO RELATED APPLICATIONS

The present disclosure is a national phase application of International Application No. PCT/CN2018/122531, filed on Dec. 21, 2018, which claims priority to Chinese Patent Application No. 201811198969.9, filed Oct. 15, 2018, the entireties of which is incorporated herein by reference.

FIELD

The present disclosure relates to the field of a fan, and in particular to a counter-rotating fan.

BACKGROUND

A fan can accelerate the transmission of airflow, increase the air blowing area to generate widespread wind, or lengthen the wind path and air blowing distance, and accelerate the air speed to increase convection speed. The fan is an indispensable device among a variety of living electronic appliances.

The existing series-connected two-stage axial flow fan has two stages of fans with the same size, and the rotation directions of the two stages of fans are the same or opposite to each other. The two stages of fans are equipped with one or two motors for driving the two stages of fans into rotation. Furthermore, in most case, a rectifier device is arranged between the two stages of fans, resulting in complicating the structure of the fan and increasing the noise. When the two stages of fans rotate in different directions, the swirl at the outlet of the first stage fan can be de-rotated by the blades of the second stage fan, to generate a straight wind to accelerate the air circulation. However, after the rectified airflow of the first stage fan reaches to the second stage fan, its strength and flow rate will be weakened.

If the length of a single blade of the fan is relatively long, the adjustment of the rotation speed is limited, otherwise the deformation of the blade is relatively serious, and the aerodynamic performance and the noise performance are degraded. Although the problem of blade deformation can be solved by using more rigid blades, the cost is higher. In this case, if the fan is a long-blade type fan with a relatively small hub, the blade roots thereof will be greatly twisted, so that the roots of the two stages of blades will generate a recirculation region. Thus, the air speed is low, and the wind cannot be blown forward, which is unfavorable to the heat dissipation of the motor and affects the service life of the motor.

For aesthetic purposes, the axial flow fan cannot be designed to be excessively thick, otherwise the appearance thereof would be seriously influenced. Moreover, if the distance between the two stages of fans is relatively small, the airflow generated by the blades of the previous stage fan, such as the leakage vortex, will easily enter the blades of the latter stage fan, resulting in significant increase of the noise peaks of the blade frequency and blade frequency multiplication, and higher noise.

SUMMARY

The present disclosure seeks to solve at least to some extent one of the problems in the related art.

Embodiments of the present disclosure are to propose a counter-rotating fan, which is stable in rotation and not easy to deform. The motor has a good cooling effect, and the strength of the central outlet air is strong.

A counter-rotating fan according to embodiments of the present disclosure includes: two impellers axially spaced apart from each other and divided into a first stage impeller and a second stage impeller, in which when the counter-rotating fan operates, airflow is blown in a direction from the first stage impeller toward the second stage impeller, at least one impeller of the two impellers is provided with multiple annular arrays of blades arranged in a radial direction of the impeller, a plurality of blades in each array are disposed around a hub of the impeller and spaced apart from each other, and a spacer ring is arranged between two adjacent arrays of blades to connect the two adjacent arrays with each other; and at least one motor configured for driving the two impellers into rotation.

The counter-rotating fan according to embodiments of the present disclosure is provided with an impeller with multiple annular arrays of blades, so that the air outlet capacity in the middle of the counter-rotating fan can be enhanced, speed distribution of the outlet wind field of the counter-rotating fan close to the center position of the fan can be improved, and the uniformity of the outlet wind field can be significantly improved. The counter-rotating fan is provided with impellers each with a spacer ring and multiple annular arrays of blades, so that the air transmission between the previous stage impeller and the latter stage impeller can be significantly strengthened, and the rigidity of the counter-rotating fan can be significantly improved. The blades are not easily deformed during long-term rotation, and the critical speed of each stage of impeller can be increased, which facilitates stable operation of the counter-rotating fan, and ensures good performance of the fan. Since the motor is generally provided in the middle of the counter-rotating fan and the impeller is provided with multiple annular arrays of blades, the blades close to the motor rotate and produce work, which can increase the speed of the wind field close to the motor, improve the cooling effect of the motor and facilitate maintaining the service life of the motor. The two stages of impellers are spaced apart from each other, so that on the one hand the vortex generated by the first stage impeller can be made gentle, and on the other hand a sufficient space is provided for installing connecting members such as motors.

In one embodiment, for the impeller provided with the spacer ring, a bending angle of each of the blades in an inner array of the two adjacent arrays is greater than or equal to a bending angle of each of the blades in an outer array of the two adjacent arrays.

In one embodiment, for the impeller provided with the spacer ring, the number of the blades in an inner array of the two adjacent arrays is greater than or equal to the number of the blades in an outer array of the two adjacent arrays.

In one embodiment, the impeller is provided with two annular arrays of blades, a difference between a diameter of the spacer ring and a diameter of the hub is an inner array difference, and a difference between an outer diameter of each of the blades in an outer array and the diameter of the hub is an outer array difference. The inner array difference is at least 0.3 times the outer array difference, and is at most 0.7 times the outer array difference.

In one embodiment, a thickness of the spacer ring is less than or equal to a maximum thickness of each of the blades.

In one embodiment, an entire surface of the spacer ring is a smooth arced surface.

In one embodiment, the counter-rotating fan includes two motors. One of the two motors is connected with one of the two impellers, the other of the two motors is connected with the other of the two impellers, and the two impellers are arranged coaxially with each other.

In one embodiment, the counter-rotating fan includes one motor. A transmission mechanism is arranged between the motor and the at least one impeller to connect the motor with the at least one impeller.

In one embodiment, the counter-rotating fan further includes a support. The motor is arranged on the support, one of the two impellers is arranged at one side of the support, and the other of the two impellers is arranged at another side of the support opposite to the one side.

In one embodiment, the support includes: an inner supporting plate, the motor being fixed on the inner supporting plate; an outer supporting ring arranged at an outer side of the inner supporting plate; and a plurality of radiating rods arranged around the inner supporting plate, one end of each radiating rod being connected with the inner supporting plate, and another end of each radiating rod being connected with the outer supporting ring.

Embodiments of the present disclosure will be given in part in the following description, become apparent in part from the following description, or be learned from the practice of the present disclosure.

Figure 1:
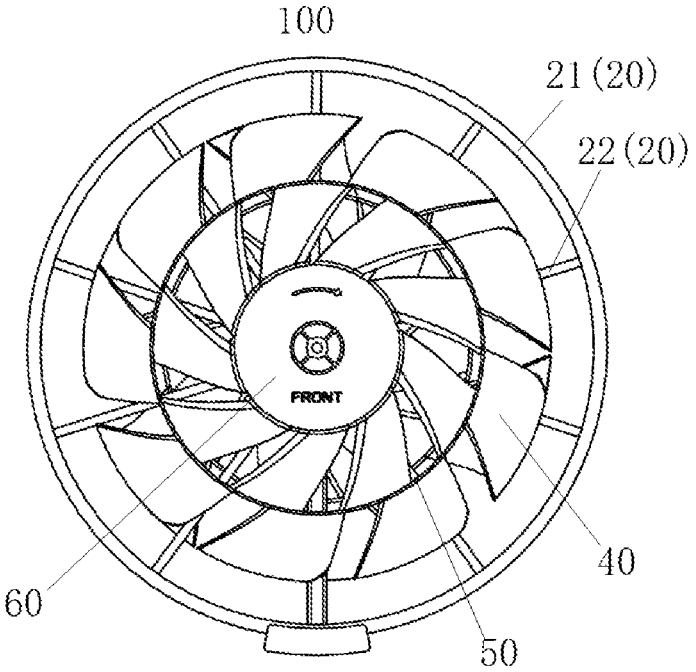
FIG. 1 is a schematic diagram of a counter-rotating fan of an embodiment of the present disclosure.

REFERENCE NUMERALS counter-rotating fan 100;
motor 10;
support 20; outer supporting ring 21; radiating rod 22;
first stage impeller 30;
second stage impeller 40;
spacer ring 50;
hub 60; locking nut 61.

DETAILED DESCRIPTION OF THE DISCLOSURE

Hereinafter, embodiments of the present disclosure are described in detail. Examples of the embodiments are shown in the accompanying drawings, in which the same or similar reference numerals are used to designate same or similar elements or elements with same or similar functions. The following embodiments described with reference to the accompanying drawings are illustrative and intended to explain the present disclosure, but may not be interpreted as the restrictions of the present disclosure.

A counter-rotating fan 100 according to embodiments of the present disclosure is described in detail below referring to the drawings.

Figure 2:
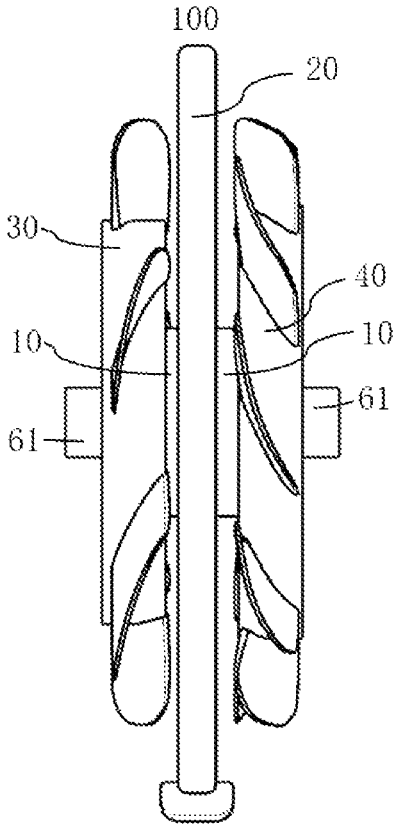
FIG. 2 is a side schematic diagram of a counter-rotating fan of an embodiment of the present disclosure.

As shown in FIG. 1 and FIG. 2, the counter-rotating fan 100 according to embodiments of the present disclosure includes two impellers and at least one motor 10. The motor 10 is configured for driving the two impellers into rotation, to provide power for the rotation of the two stages of impellers.

The two impellers are axially spaced apart from each other and divided into a first stage impeller 30 and a second stage impeller 40. When the counter-rotating fan 100 operates, airflow is blown in a direction from the first stage impeller 30 toward the second stage impeller 40. The two stages of impellers are spaced apart from each other. The first stage impeller 30 and the second stage impeller 40 may have different rotation speeds, or may have different rotation directions.

In embodiments of the present disclosure, at least one impeller of the two impellers is provided with multiple annular arrays of blades. That is, the first stage impeller 30 may be provided with multiple annular arrays of blades, while the second stage impeller 40 is provided with only one annular array of blades. In one embodiment, the second stage impeller 40 may be provided with multiple annular arrays of blades, while the first stage impeller 30 is provided with only one annular array of blades. In one embodiment, both the second stage impeller 40 and the first stage impeller 30 are provided with multiple annular arrays of blades. If one impeller is provided with multiple annular arrays of blades, it can be provided with two annular arrays of blades or three annular arrays of blades, which is not limited here.

The multiple annular arrays of blades are arranged in a radial direction of the impeller. Blades in each array are disposed around the hub 60 of the impeller and spaced apart from each other. A spacer ring 50 is arranged between two adjacent arrays of blades to connect the two adjacent arrays with each other. The impeller provided with the spacer ring 50 and multiple annular arrays of blades can significantly improve the rigidity of a single stage impeller of the counter-rotating fan 100, so that the blades are not easily deformed during long-term rotation.

Compared with a counter-rotating fan 100' in which the two stages of impellers have a single annular array of blades, the uniformity of the outlet wind field can be significantly improved by providing at least one stage of impellers with multiple annular arrays of blades.

Figure 5:
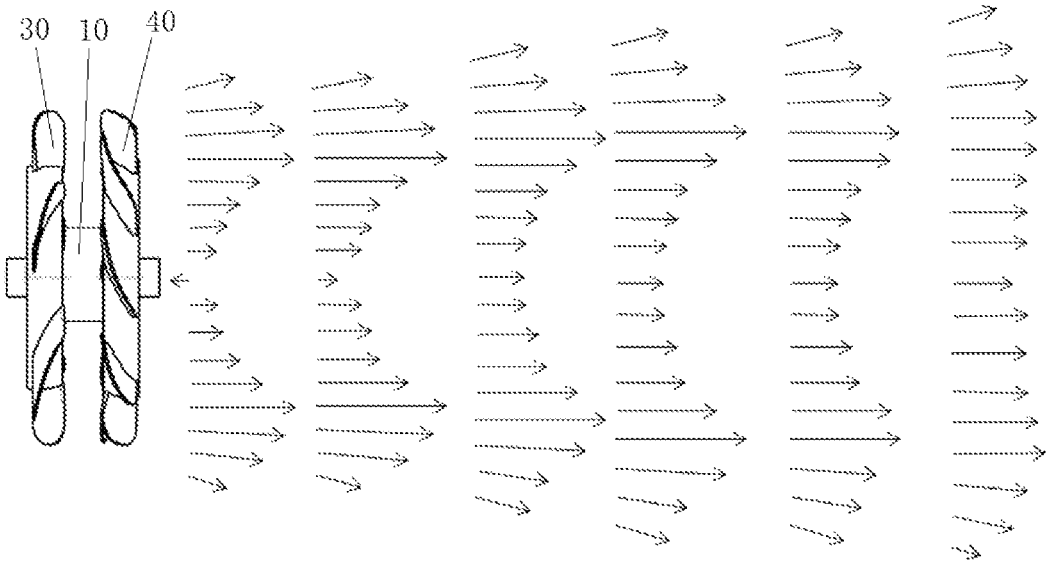
FIG. 5 is a schematic diagram of a wind field of a counter-rotating fan of an embodiment of the present disclosure.
Figure 6:
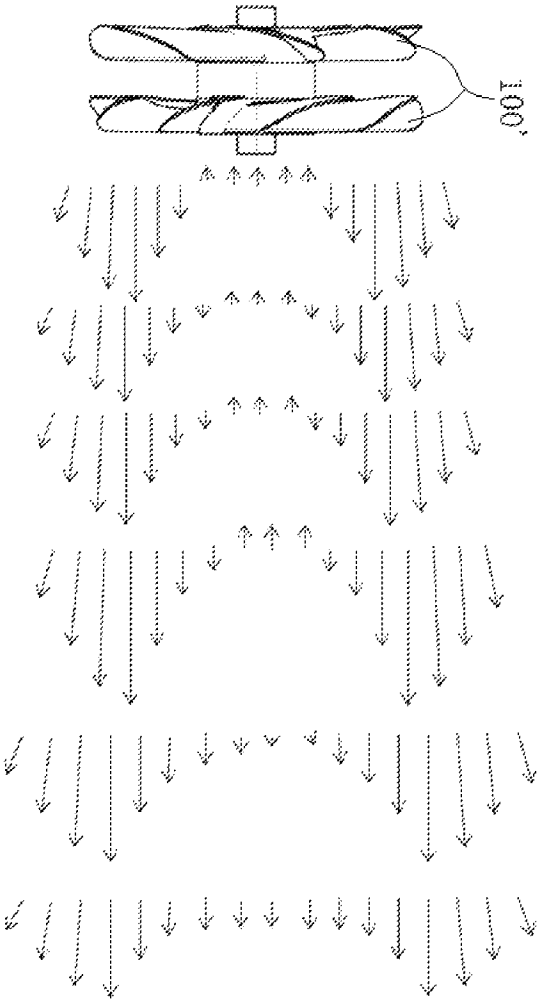
FIG. 6 is a schematic diagram of a wind field of a current counter-rotating fan, in which each of two impellers of the current counter-rotating fan includes a single annular array of blades.

Hereinafter, it will be described with reference to a schematic diagram of a wind field shown in FIG. 5 and FIG. 6. FIG. 5 is a schematic diagram of an outlet wind field of a counter-rotating fan 100 in which each of the two stages of impellers is provided with two annular arrays of blades. FIG. 6 is a schematic diagram of an outlet wind field of a counter-rotating fan 100' in which each of the two stages of impellers is provided with a single annular array of blades.

It can be seen from FIG. 6 that if each of the two stages of impellers is provided with a single annular array of blades, the outlet wind field has a larger low-speed recirculation region at the position close to the axis, and the sensation of wind is weak. Furthermore, the maximum speed of the outlet wind field appears at the upper middle position of each blade close to the blade tip.

It can be seen from FIG. 5 that if each of the two stages of impellers is provided with two annular arrays of blades, although a recirculation region still exists at a middle position close to the axis, the recirculation region is significantly reduced. The strength of the outlet wind field tends to be more uniform. Compared with the two stages of impellers with a single annular array of blades, the uniformity of the outlet wind field is improved, and the comfort experience for users is enhanced.

It is understood that for portions of the impeller, the closer the position thereof from the rotation axis is, the lower the liner speed thereof is. Therefore, the sensation of wind is generally weaker at the air outlet side of the fan adjacent to the hub 60. However, for portions of the impeller, the farther the position thereof from the rotation axis is, the greater the liner speed thereof is, and the stronger the working capacity thereof is. If the impeller is provided with a single annular array of blades, since the wind strength is weak and the air pressure is low in a region of the outlet wind field adjacent to the rotation axis, and the air pressure at the outer array is higher, a recirculation region can be generated at the outlet wind field adjacent to the impeller.

However, if the impeller is provided with two or more annular arrays of blades, even if the blades at the inner array and the blades at the outer array have the same profiles and the same number, the bearing capacity is enhanced, the working capacity is increased, and the sensation of wind is stronger when the multiple annular arrays of blades rotate at the same time, since a spacer ring 50 is provided between the blades at the inner array and the blades at the outer array. Therefore, the outlet wind field tends to be significantly uniform.

It should be noted that the inner array and the outer array mentioned herein are relative concepts. That is, if the impeller is provided with two or more annular arrays of blades, the blades adjacent to the rotation axis of the impeller between any two arrays of blades are referred to as the blades at the inner array, and the blades away from the rotation axis of the impeller between any two arrays of blades are referred to as the blades at the outer array.

In addition to the enhanced uniformity of the wind field, there are other advantages for the impeller with multiple annular arrays of blades. In one embodiment, for a conventional impeller, the farther the blades from the hub 60 are, the lower the rigidity of the blades is, and the weaker the bearing capacity of the blades is, so that the working capacity is limited. However, for the impeller provided with a spacer ring 50, the blades at the inner array in two adjacent arrays are connected to the spacer ring 50 at the blade tips, and the blades at the outer array in the two adjacent arrays are connected to the spacer ring 50 at the blade roots, so that the rigidity of the blades is greatly enhanced.

Moreover, compared with the impeller provided with a single annular array of blades, the structure of the impeller provided with multiple annular arrays of blades can be variously changed, and the working capacity thereof can be further improved. In one embodiment, the blades at different arrays can be provided with different profiles, and the blades can be provided with profiles that are easier to generate swirl by taking advantage of the characteristics of low liner speed but increased rigidity and strength of the blades at the inner array. In one embodiment, the number of the blades at the inner array can be configured to be greater than the number of the blades at the outer array, so that the working capacity of the blades at the inner array can be improved by increasing the density of the blades. Furthermore, for example, the bending angle of each of the blades at the inner array can be configured to be greater than the bending angle of each of the blades at the outer array, or the axial dimension of the blades at the inner array can be changed.

Of course, if there is only a single impeller in the fan, even if the impeller is provided with two or three annular arrays of blades, the sensation of wind of the outlet wind field would still be greatly weakened.

In one embodiment, when a single impeller rotates, a circumferential vortex-like wind field is formed, and a blade tip airflow leakage vortex can be generated at the blade tip. If the impeller is provided with two or more annular arrays of blades, for each spacer ring 50, the blade roots of an annular array of blades are connected at the outer side of the spacer ring 50, and the blade tips of another annular array of blades are connected at the inner side of the spacer ring 50. The condition of the vortex formed by the outlet wind field at the spacer ring 50 is complicated, which results in not only additional airflow noise, but also unstable airflow and consumption of air pressure caused by the turbulent airflow.

However, on the premise of the two impellers rotating simultaneously and reasonable setting the structural parameters, the outlet air generated by the two stages of impellers (30, 40) can be mutually de-rotated. In particular, the rotation directions of the airflows respectively generated at the two stages of impellers with opposite rotation directions are opposite to each other. As shown in FIG. 2, the vortex generated by the second stage impeller 40 can be de-rotated by the vortex generated by the first stage impeller 30, or can be blown away by the straight wind blown out from the first stage impeller 30, so that the straight wind in the middle position is strengthened, thereby stabilizing the outlet air of the counter-rotating fan 100. Since the air blowing distance of the straight wind is long, the widespread wind can be spread outward from the periphery of the second stage impeller 40.

It should be noted that the counter-rotating fan 100 of embodiments of the present disclosure can be applied to devices that need to discharge air, such as electric fans, circulating fans, ventilating fans, air-conditioning fans, etc. The counter-rotating fan 100 of embodiments of the present disclosure is mainly used to promote air flow instead of exchange heat.

It should be noted that the bending angle mentioned herein refers to a changing angle that the blade is changed in a circumferential direction during the extension of the blade from a leading edge to a trailing edge, that is, the difference between a leading edge installation angle and a trailing edge installation angle of the blade. It is well known in the art that each blade of the impeller has a leading edge and a trailing edge ("the trailing edge" can also be referred to as "the tail edge"). The fluid flows into the blade channel from the leading edge of the blade and flows out of the blade channel from the trailing edge of the blade according to the flow direction of the fluid.

Figure 7:
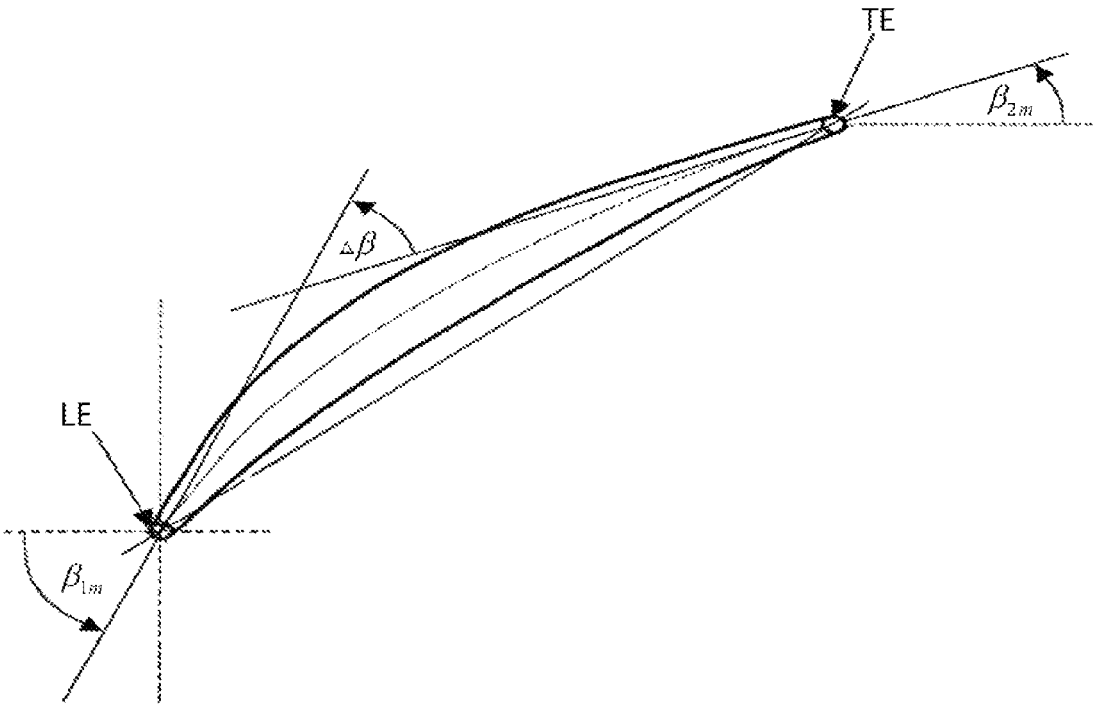
FIG. 7 is a schematic diagram of profile parameters of a blade of an embodiment of the present disclosure.

Referring to FIG. 7, a crescent section is formed by intersecting the blade with an equal-diameter cylindrical surface coaxial with the impeller. For convenience of explanation in the figure, the leading edge of the blade is illustrated as LE, and the trailing edge of the blade is illustrated as TE. An angle between the tangent of the central arced curve of said section at the leading edge LE and the tangent of the leading edge LE on the equal-diameter cylindrical surface is referred to as a leading edge installation angle $\beta_{1m}$. An angle between the tangent of the central arced curve of said section at the trailing edge TE and the tangent of the trailing edge TE on the equal-diameter cylindrical surface is referred to as a trailing edge installation angle $\beta_{2m}$. The difference between the leading edge installation angle $\beta_{1m}$ and the trailing edge installation angle $\beta_{2m}$ is equal to the bending angle $\Delta\beta$.

Figure 3:
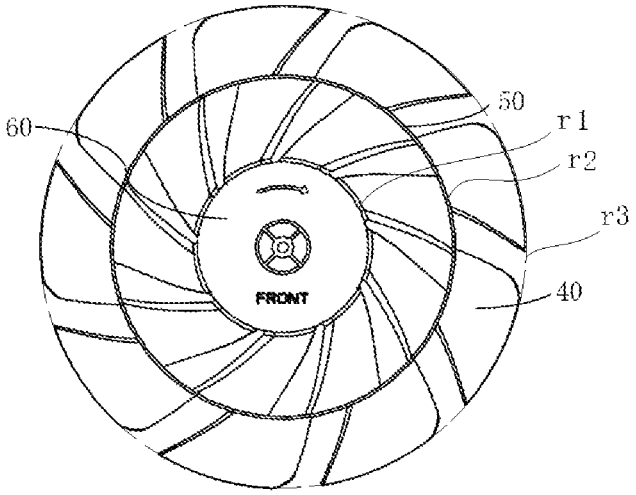
FIG. 3 is a front schematic diagram of a second stage impeller of an embodiment of the present disclosure.
Figure 4:
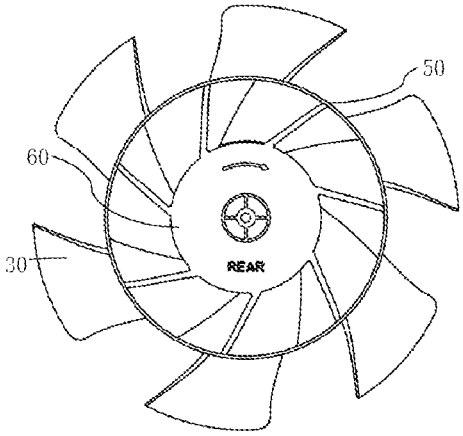
FIG. 4 is a front schematic diagram of a first stage impeller of an embodiment of the present disclosure.

In some embodiments of the present disclosure, as shown in FIG. 1, FIG. 3 and FIG. 4, for the impeller provided with the spacer ring 50, a bending angle of each of the blades in an inner array of the two adjacent arrays is greater than or equal to a bending angle of each of the blades in an outer array of the two adjacent arrays. Since the blades at the inner array have increased rigidity and strong bearing capacity, and do not affect the profile of the blades at the outer array, the working capacity of the blades at the inner array may be improved by increasing the bending angle of each of the blades at the inner array.

The larger the bending angle of each of the blades at the inner array is, the greater the turning amplitude of the airflow during its passage of the inner array is, and the more the swirl is generated. The more the swirl in the outlet airflow is, the stronger the working capacity of the fan is. That is, the strength and the air pressure are greater. As a result, on the one hand, the air outlet capacity in the middle position of the counter-rotating fan 100 is improved, and on the other hand, the heat dissipation and cooling of the motor 10 close to the hub 60 can be accelerated.

In some embodiments of the present disclosure, for the impeller provided with the spacer ring 50, the number of the blades in an inner array of the two adjacent arrays is equal to the number of the blades in an outer array of the two adjacent arrays. In other embodiments, as shown in FIG. 1, FIG. 3 and FIG. 4, for the impeller provided with the spacer ring 50, the number of the blades in an inner array of the two adjacent arrays is greater than the number of the blades in an outer array of the two adjacent arrays. It can solve the defect of weak working capacity of the blades at the inner array and improve the uniformity of the outlet air of the counter-rotating fan 100 by designing more blades at the inner array. A spacer ring 50 is provided between the blades at the inner array and the blades at the outer array, so that the bending angle of each of the blades at the spacer ring 50 is enlarged.

In some embodiments of the present disclosure, as shown in FIG. 3, the impeller is provided with two annular arrays of blades, a difference between the diameter of the spacer ring 50 and the diameter of the hub 60 is referred to as an inner array difference, and a difference between the outer diameter of each of the blades in the outer array and the diameter of the hub 60 is referred as to an outer array difference. The inner array difference is at least 0.3 times the outer array difference, and is at most 0.7 times the outer array difference. In one embodiment, the diameter of the hub 60 is denoted as r1, the diameter of the spacer ring 50 is denoted as r2, and the outer diameter of each of the blades in the outer array is denoted as r3. The ratio of the difference between r2 and r1 to the difference between r3 and r1 is in the range of 0.3-0.7. That is, the ratio $(r2-r1)/(r3-r1)$ is 0.3-0.7. Herein, the outer diameter of each of the blades in the outer array is referred to as a diameter of a circle formed by the most distant points of the blades in the outer array from the rotation axis.

If the blades in the outer array are designed to be twisted to a greater extent, the larger value is taken. That is, the difference between the diameter of the rim of each of the blades in the outer array and the diameter of the rim of each of the blades in the inner array is relatively small, and the area of the wind field in the inner array which is needed to be increased is larger, so that the blades in the outer array are not easily to break during rotation due to excessively large twisting. If the blades in the outer array are designed to be twisted to a less extent, the smaller value is taken. That is, the difference between the diameter of the rim of each of the blades in the outer array and the diameter of the rim of each of the blades in the inner array is relatively large, and the area of the wind field in the inner array which is needed to be increased is smaller, so that the blades in the outer array are not easily to break. This is the result of comprehensive consideration of the strength of the blades in the outer array and the airflow circulation capacity of the blades in the inner array.

In some embodiments of the present disclosure, the thickness of the spacer ring 50 is less than or equal to the maximum thickness of each blade. If each blade of the impeller is designed to be excessively thick, there will be two noise effects. If each blade of the first stage impeller 30 is excessively thick, its trailing edge wake may interfere with the leading edge of each blade of the second stage impeller 40, resulting in impact noise. If each blade of the second stage impeller 40 is excessively thick, wake wide band frequency noise can be generated at the spacer ring 50 of the second stage impeller 40. Therefore, the thickness of the spacer ring 50 and each blade should be reasonably designed, and an appropriate thickness difference should be selected, to reduce the noise, increase the aesthetics, and maintain a better air outlet performance of the counter-rotating fan 100.

In one embodiment, an entire surface of the spacer ring 50 is a smooth arced surface. The front portion, the side portion or the rear portion of the spacer ring 50 needs to be designed with a smooth arced shape, such as a round shape or an elliptical shape, etc., to avoid additional airflow noise.

In one embodiment, each of the blades in the outer array is connected with the outer wall of the spacer ring 50, one end of each of the blades in the inner array is connected with the inner wall of the spacer ring, and another end of each of the blades in the inner array is connected with the hub 60. In this way, the blades in the inner array and the blades in the outer array are not easily to break during rotation at high speed.

In some embodiments of the present disclosure, as shown in FIG. 2, the counter-rotating fan includes two motors 10. One of the two motors 10 is connected with one of the two impellers, the other of the two motors 10 is connected with the other of the two impellers, and the two impellers are arranged coaxially with each other. One of the two motors 10 controls one of the two stages of impellers, and the other of the two motors 10 controls the other of the two stages of impellers, which facilitates the adjustment of the rotation speed of the motors 10 to change the rotation speed of the two stages of impellers, and facilitates the installation and arrangement to be beneficial for the symmetry of the counter-rotating fan 100. Each of the two impellers is connected with the motor shaft of the corresponding motor 10 through locking nuts 61.

In some embodiments of the present disclosure, the counter-rotating fan includes one motor 10, and a transmission mechanism is arranged between the motor 10 and at least one impeller to connect the motor with the at least one impeller. The rotation is driven by a single motor 10, which can further reduce the overall noise of the counter-rotating fan 100, and simplify the structure of the counter-rotating fan 100. Herein, the transmission mechanism is a planetary gear mechanism. In one embodiment, a motor shaft extends outward from each of both ends of the motor 10 in the axial direction. One end of each of the motor shafts is connected with the hub 60 of the first stage impeller 30, and another end of each of the motor shafts is connected with the hub 60 of the second stage impeller 40 through the planetary gear mechanism. The planetary gear mechanism can adopt a planetary mechanism known in the related art, which is not limited herein. As a result, the counter-rotating fan 100 is compact, the noise is lower during the rotation of the second stage impeller 40 and the first stage impeller 30, and the rotation speed ratio can be adjusted through the selection of the transmission mechanism.

In some embodiments of the present disclosure, as shown in FIG. 1, the counter-rotating fan 100 further includes a support 20. The motor 10 is arranged on the support 20, one of the two impellers is arranged at one side of the support 20, and the other of the two impellers is arranged at another side of the support 20 opposite to the one side. The support 20 is configured to support the two stages of impellers during rotation, to enhance the stability during rotation.

In one embodiment, the support 20 includes an inner supporting plate, an outer supporting ring 21 and radiating rods 22. Herein, the motor 10 is fixed on the inner supporting plate (corresponding to the supporting component for the motor). The outer supporting ring 21 is arranged at an outer side of the inner supporting plate. Radiating rods 22 are arranged around the inner supporting plate. One end of each radiating rod 22 is connected with the inner supporting plate, and another end of each radiating rod 22 is connected with the outer supporting ring 21. The inner supporting plate provides supporting function and space for the installation of the motor, and the structural arrangement of the radiating rods 22 and the outer supporting ring 21 can reduce the interference to the airflow.

In order to better understand the solution of the embodiments of the present disclosure, the structure of the counter-rotating fan 100 in an embodiment of the present disclosure is described below with reference to FIG. 1-FIG. 5.

As shown in FIG. 1 and FIG. 2, a counter-rotating fan includes a first stage impeller 30, a second stage impeller 40, a motor 10 and a support 20. The first stage impeller 30 and the second stage impeller 40 are axially spaced apart from each other. When the counter-rotating fan 100 rotates, the airflow is blown in a direction from the first stage impeller 30 toward the second stage impeller 40.

As shown in FIG. 3 and FIG. 4, each of the first stage impeller 30 and the second stage impeller 40 is provided with blades in an inner annular array and blades in an outer annular array which are arranged in a radial direction. The blades in the inner array and the blades in the outer array are spaced apart from each other through a spacer ring 50. Herein, one end of each of the blades in the inner array is connected with a hub 60, another end of each of the blades in the inner array is connected with the spacer ring 50, and each of the blades in the outer array is connected with the outer portion of the spacer ring 50.

A bending angle of each of the blades in the inner array is greater than a bending angle of each of the blades in the outer array, and the number of the blades in the inner array is greater than the number of the blades in the outer array. A thickness of the spacer ring 50 is less than a maximum thickness of each of the blades. The spacer ring 50 is a smooth arced surface.

A motor shaft extends outward from each of both ends of the motor 10 in the axial direction. One end of each of the motor shafts is connected with the first stage impeller 30, and another end of each of the motor shafts is connected with the second stage impeller 40 through a transmission mechanism. The motor 10 is arranged on the inner supporting plate of the support 20.

The support 20 further includes an outer supporting ring 21 and radiating rods 22. The outer supporting ring 21 is arranged at an outer side of the inner supporting plate. Radiating rods 22 are arranged around the inner supporting plate. One end of each radiating rod 22 is connected with the inner supporting plate, and another end of each radiating rod is connected with the outer supporting ring 21.

As shown in FIG. 5, the recirculation region of the wind field in the middle portion of the counter-rotating fan 100 close to the hub 60 is relatively small, so that the entire outlet wind field is relatively uniform, with both widespread wind and long-distance straight wind. When the first stage impeller 30 rotates counterclockwise, the second stage impeller 40 rotates clockwise. Conversely, when the first stage impeller 30 rotates clockwise, the second stage impeller 40 rotates counterclockwise.

In the description of the present disclosure, it is to be understood that orientation or position relationships indicated by terms "center," "length," "upper," "lower," "front," "back," "inner," "outer," "clockwise," "counterclockwise," "axial," "radial," and the like are orientation or position relationships shown in the drawings, are adopted not to indicate or imply that indicated devices or components must be in orientations and structured and operated in orientations but only to conveniently describe the present disclosure and simplify the description, and are not to be construed as limiting the present disclosure.

In addition, terms "first" and "second" are only adopted for description and should not be understood to indicate or imply relative importance or to implicitly indicate the number of indicated features. Therefore, a feature defined by "first" and "second", such as "first stage impeller" and "second stage impeller", may explicitly or implicitly indicate inclusion of one or more such features.

In the description of the present disclosure, "multiple" means more than two, unless otherwise limited definitely and specifically.

In the present disclosure, unless otherwise definitely specified and limited, terms "mount," "mutually connect," "connect," "fix," and the like should be broadly understood. In one embodiment, the terms may refer to fixed connection and may also refer to detachable connection or integrated connection. The terms may refer to mechanical connection, electrical connection. The terms may refer to direct mutual connection, may also refer to indirect connection through a medium and may refer to communication in two components or an interaction relationship of the two components, unless otherwise definitely limited.

In the present disclosure, unless otherwise explicitly specified and defined, a first feature being "on" or "under" on a second feature may indicate that the first feature and the second feature are in direct contact, or the first feature and the second feature are in indirect contact through an intermediate medium. Moreover, the first feature being "above", "over" and "on" the second feature may indicate that the first feature is directly above or obliquely above the second feature, or simply indicate that a horizontal height of the first feature is higher than a horizontal height of the second feature. The first feature being "below", "under" and "underside" the second feature may indicate that the first feature is directly or obliquely below the second feature, or simply means that a horizontal height of the first feature is lower than a horizontal height of the second feature.

In the description of this specification, the description with reference to the terms "an embodiment," "some embodiments," "examples," "specific examples," or "some examples," and the like means that a specific feature, structure, material, or characteristic described in connection with the embodiment or example are included in at least one embodiment or example of the present disclosure. In this specification, the schematic representation of the above-mentioned terms does not necessarily refer to the same embodiment or example. Moreover, the specific features, structures, materials, or characteristics described may be combined in a suitable manner in any one or more embodiments or examples.

What is claimed is:

1. A counter-rotating fan, comprising:

two impellers having a common rotation axis defining an axial direction, the two impellers being spaced apart in the axial direction to form a first stage impeller and a second stage impeller;

at least one motor disposed axially between the two impellers and configured for driving the two impellers into counter-rotation such that airflow is blown in a direction from the first stage impeller toward the second stage impeller; each respective impeller of the two impellers comprising:

multiple annular arrays of blades arranged in a radial direction of the respective impeller, a plurality of the blades in each array of blades are disposed around a hub of the respective impeller and spaced apart from each other, and a spacer ring is arranged between two adjacent arrays of blades of the multiple annular arrays of blades to connect the two adjacent arrays of blades;

the blades of a radially inner array of the two adjacent arrays having a configuration that generates swirl to accelerate the heat dissipation and cooling of the at least one motor close to the hub, the configuration comprising a number of the blades in the radially inner array of the two adjacent arrays is greater than a number of the blades in a radially outer array of the two adjacent arrays, and a bending angle of each of the blades in the radially inner array of the two adjacent arrays is greater than a bending angle of each of the blades in the radially outer array of the two adjacent arrays.

2. The counter-rotating fan of claim 1, wherein at least one of the two impellers is provided with two annular arrays of blades, a difference between a diameter of the spacer ring and a diameter of the hub is an inner array difference, and a difference between an outer diameter of each of the blades in the radially outer array and the diameter of the hub is an outer array difference, the inner array difference is at least 0.3 times the outer array difference and is at most 0.7 times the outer array difference.

3. The counter-rotating fan of claim 1, wherein a thickness of the spacer ring is less than or equal to a maximum thickness of each of the blades of at least one impeller of the two impellers.

4. The counter-rotating fan of claim 1, wherein an entire surface of the spacer ring is a smooth arced surface.

5. The counter-rotating fan of claim 1, wherein the counter-rotating fan comprises two motors, one of the two motors is connected with one of the two impellers, the other of the two motors is connected with the other of the two impellers.

6. The counter-rotating fan of claim 1, wherein the counter-rotating fan further comprises a support, the at least one motor is arranged on the support, one of the two impellers is arranged at one side of the support, and the other of the two impellers is arranged at another side of the support opposite to the one side.

* * * * *